United States Patent [19]

Clugage

[11] 4,192,504

[45] Mar. 11, 1980

[54] METHOD AND APPARATUS FOR SUPPORTING A GOLF BALL

[76] Inventor: Robert G. Clugage, P.O. Box 5905, Incline Village, Nev. 89450

[21] Appl. No.: 804,992

[22] Filed: Jun. 9, 1977

[51] Int. Cl.[2] ..... A63B 57/00

[52] U.S. Cl. ..... 273/33

[58] Field of Search ..... 273/33, 203, 204, 206, 273/207, 208, 209, 210, 211, 212; D5/10.1

[56] References Cited

U.S. PATENT DOCUMENTS

| | | | |
|---|---|---|---|
| 71,470 | 11/1926 | Lugar | D34/5 |
| 1,554,721 | 9/1925 | Getchell | 273/33 |
| 1,623,782 | 4/1927 | Dent et al. | 273/33 |
| 2,082,811 | 6/1937 | Thorup | 273/33 |
| 3,448,984 | 6/1969 | Dreyfus | 273/33 |
| 3,907,289 | 9/1975 | Bondu, Sr. | 273/33 |

FOREIGN PATENT DOCUMENTS

| | | | |
|---|---|---|---|
| 601426 | 5/1948 | United Kingdom | 273/33 |

*Primary Examiner*—Richard C. Pinkham
*Assistant Examiner*—T. Brown
*Attorney, Agent, or Firm*—Herbert C. Schulze

[57] ABSTRACT

This is a method, and an apparatus (a golf tee), for practicing the method wherein a golf ball may be supported in an appropriate manner for being struck by a golf club wherein increased distance and accuracy may be achieved by a unique combination of aligning and supporting steps. It is characterized by the use of a special golf tee wherein a rib is formed on the stem and another rib is formed in the supporting socket, and the stem of the tee is curved so as to provide complete alignment and minimized resistance to the force of the blow.

8 Claims, 5 Drawing Figures

METHOD AND APPARATUS FOR SUPPORTING A GOLF BALL

CROSS REFERENCE TO RELATED PATENT APPLICATIONS

This application is related to my co-pending patent application, Ser. No. 760,250, Filed Jan. 17, 1977, entitled "Tilted Golf Tee", now abandoned.

BACKGROUND OF THE INVENTION

1. Field of the Invention

This invention is in the general field of golfing, and is more particularly related to a method for supporting a golf ball above ground level, together with an apparatus therefore, and is still more particularly directed to such a method and apparatus wherein alignment of the ball in cooperative relationship with the tee is utilized together with the reduction of resistance of the tee to movement of the ball when being struck by the club.

2. Description of the Prior Art

There have been many developments in the field of golf tees. The customary tee, as generally used, is well known to those skilled in the art, and there have been such developments as those shown in U.S. Pat. Nos. 3,966,214; 3,414,268; 3,406,978; 2,146,736; and British Pat. No. 327,895. These are representative examples of attempts which have been made to provide tees different than the normally customary configuration. There have been others, such as rubber tees having an attached weight, or the like, to prevent loss.

All of the tees for golf use which have been developed have been directed at various and sundry theoretical advantages, generally having to do with protection from being scratched by the point of the tee, insurance from loss of the tee when used, reduced breakage of the tees, and the like. The prior art has not included tees specifically directed to directional accuracy of the striking of the ball from the tee, together with the appropriate minimization of resistance of both the tee and the ball in connection with the tee to the striking force. In this respect, my invention is unique and completely distinguished from the prior art.

SUMMARY OF THE INVENTION

Golfing is an extremely important activity for persons of almost any age, and a wide variety of physical conditions. It is a sport which can be enjoyed by most people, even those in ill health, and therefore has a very wide following.

There are many critical aspects to the game of golf, as are known to those skilled in that activity. One of the important aspects is appropriate directional alignment of the ball in position prior to being struck with a club. Another very important factor is the distance traveled, and particularly in the case of driving (the first shot for each hole).

Minor amounts of increased yardage become extremely important, and if one who would normally drive 200 yards can obtain 210 yards, it is a big improvement and a big advantage.

I have made a complete study of the factors involved in the yardage obtained from driving and also in the ability to maintain appropriate and superior directional control.

My previously mentioned co-pending application Ser. No. 760,250, filed Jan. 17, 1977, now abandoned, was, and still is, an improvement over the normal golf tee.

Now, however, I have made considerably more progress and have developed a radically changed and improved golf tee, and a method by using such a tee for supporting a golf ball for driving wherein increased yardage is obtained due to minimized resistance of the tee and ball combination to the force of the golf club being used.

I have accomplished the minimized resistance by a specially curved tee arrangement with a fin or rib which allows for proper positioning in such a manner that it presents limited resistance to a golf club when being struck by a club, and also wherein the fin is utilized, with an extension, to obtain proper alignment towards the direction in which the golf ball is desired to travel.

I have also combined a supporting rib within the socket in which the ball is held, which allows the ball to travel freely from the tee. When the ball is struck under normal conditions, it is deformed, and has a tendency to flow, or extrude, into the socket supporting it. This momentary reaction causes a limited amount of suction and increased friction and resistance which makes a difference in the yardage being obtained. Additionally, resistance of the tee under normal circumstances to the head of the club is another factor causing less than optimum driving distance.

Another feature of the tee of this invention is that the special fin or rib causes the tee to move outward when it is struck in a smooth and proper directional manner so that the flight of the ball is not altered by an improper tilting or the like.

It is an object of this invention to provide a method for supporting a golf ball to be struck by a golf club wherein the ball is supported in such a manner that there will be limited deformation into the supporting structure.

Another object of this invention is to provide a method and apparatus for supporting the ball such as described above wherein the supporting member has reduced resistance to the force of a club striking it.

Another object of this invention is to provide such a method and apparatus wherein a special sighting guide is provided in cooperative relationship with the fin, or rib.

Another object of this invention is to provide a golf tee which has increased strength due to its special angular construction and supporting fin for the stem of the tee.

The foregoing and other objects and advantages will become apparent to those skilled in the art upon reading the description of a preferred embodiment which follows, in conjunction with a review of the appended drawings.

DESCRIPTION OF A PREFERRED EMBODIMENT

Figure 1:
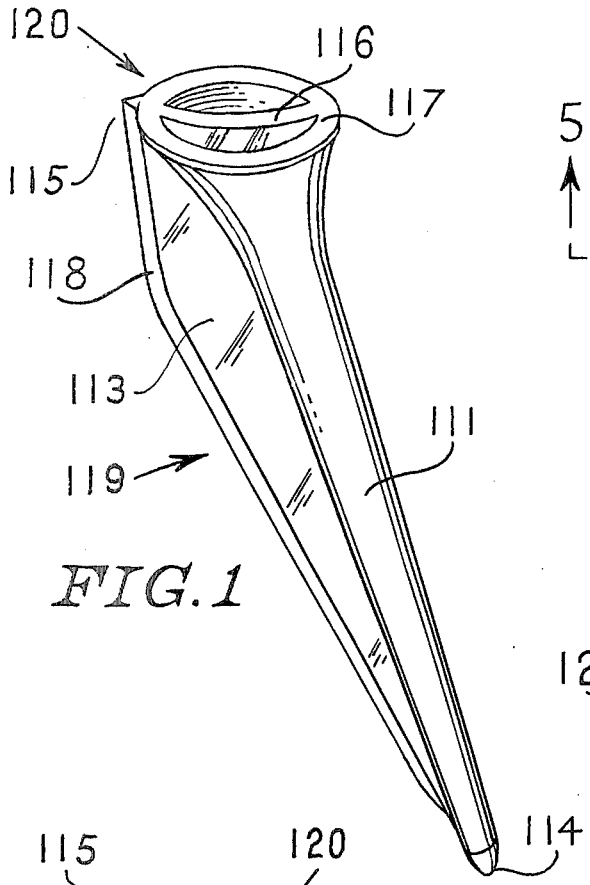
FIG. 1 is a perspective of a preferred embodiment of a golf tee to practice the method of this invention.
Figure 2:
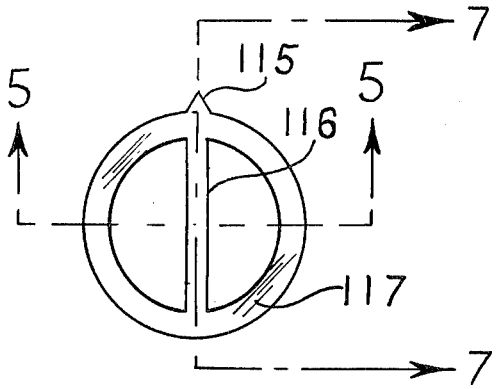
FIG. 2 is a top view of the golf tee of FIG. 1.
Figure 3:
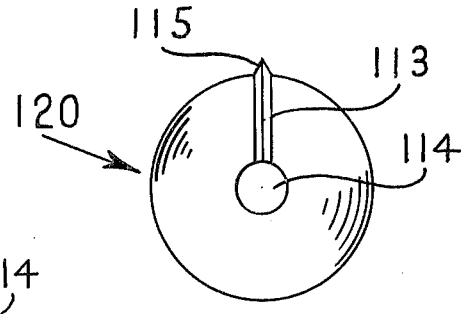
FIG. 3 is a bottom view of the golf tee of FIG. 1.
Figure 4:
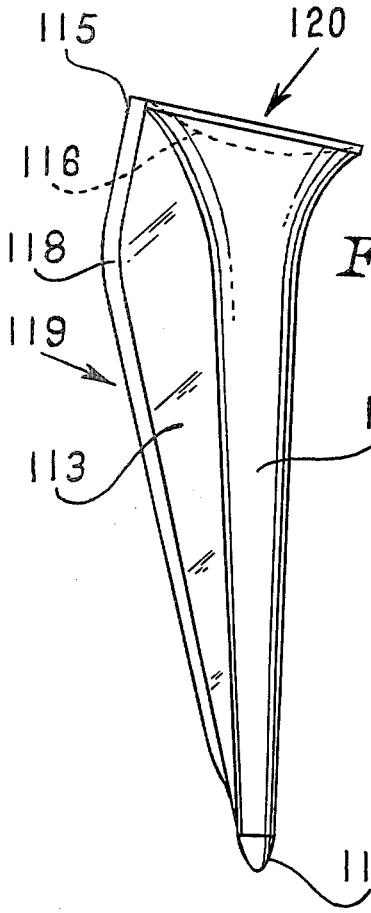
FIG. 4 is a side elevation of the golf tee of FIG. 1.
Figure 5:
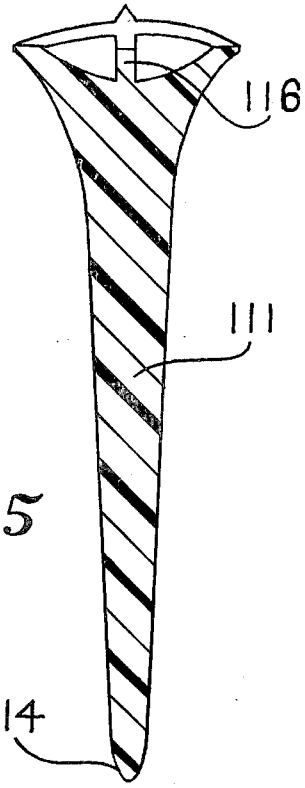
FIG. 5 is a section on 5—5 of FIG. 2.

FIGS. 1, 2, 3, 4, and 5, can be all considered jointly. These FIGURES shows a preferred embodiment of a golf tee particularly designed to practice the method of this invention. The golf tee comprises a tapered stem 111 having a pointed end 114 suitable to be easily inserted into the ground, generally round slightly cupped area 120 which is used to support a ball, a fin 113, and a pointer 115 at the top of the fin.

The cupped portion for supporting the ball comprises of a cavity having a rib with a curved upper surface 116 as illistrated, and a supporting rim 117.

The rib is so designed as to be in the same plane as the fin 113 and the pointer 115.

It will be observed that the head of the tee, that is the part which supports the ball, which has the numeral 120, generally is angularly disposed with relationship to the stem 111. Under some circumstances it may be desired to have the head in customary relationship to the stem but otherwise using the elements of this invention.

It is also felt most desirable, in some cases, to have a rather smooth curve to the stem 111 rather than being in a generally straight configuration as herein shown. When the curved stem is used, it will essentially be an extension of the curvature which will be seen particularly well in FIG. 4 under the head of the tee and going towards the stem. In that case, the stem should continue around in a smooth curve until it extends out in an angular direction of approximately 30°. These variations will be known to those skilled in the art.

Figure 7:
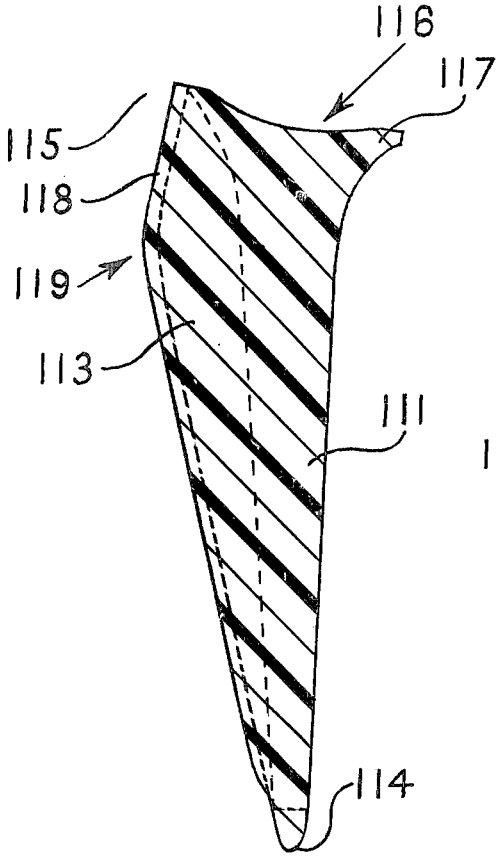
FIG. 7 is a section on 7—7 of FIG. 6.
Figure 6:
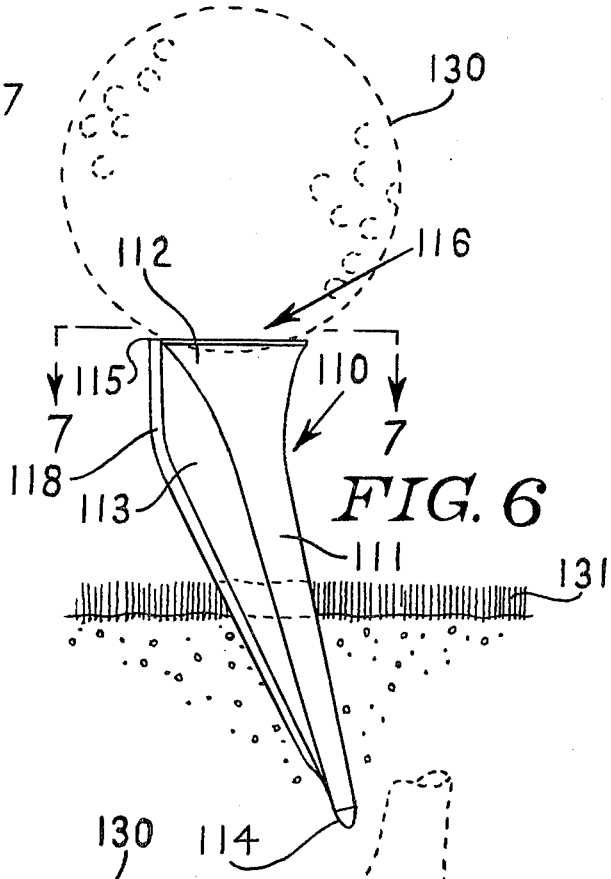
FIG. 6 is a side elevation, in reduced scale, of the device of FIG. 1 with a golf ball shown in place in phantom.
Figure 8:
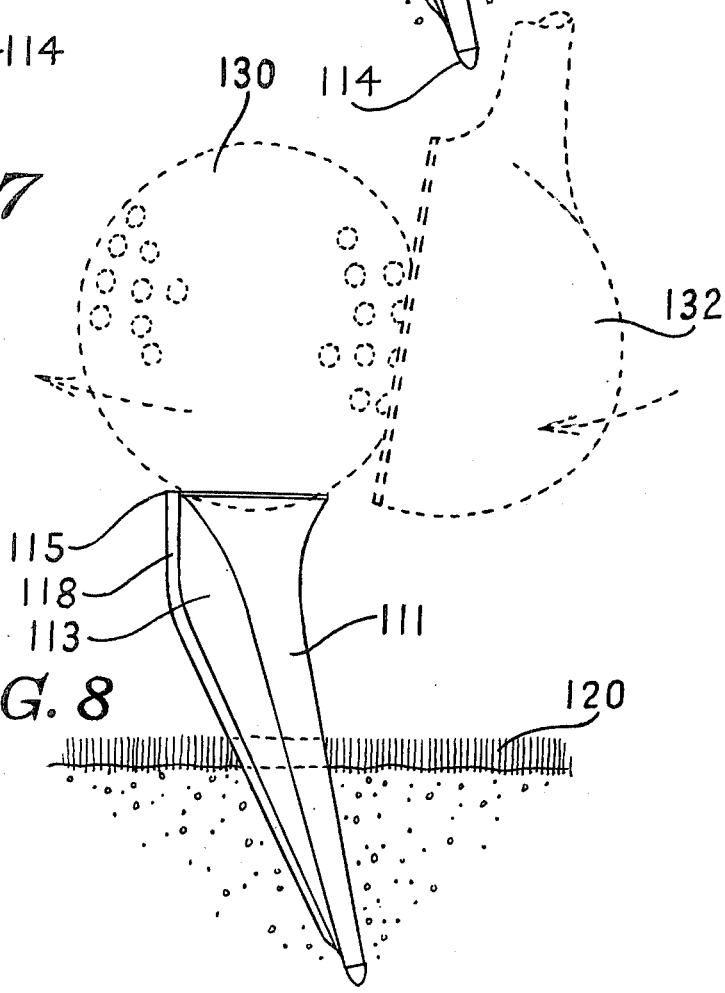
FIG. 8 is the same view as FIG. 6, but with the effect of a golf club, shown in phantom striking the ball.

The unique effect which will be achieved by utilizing this method and apparatus will be easily understood upon examining FIGS. 6, 7, and 8.

A ball 130 is shown in phantom in FIG. 6 in place upon the tee. It is recognized that for the purposes of this illustration the tee may be considered a bit high over the turf, 131. This has purposely been done for the purposes of this illustration to allow sufficient space for clarity of observation. In some cases the tee may actually be this high above the turf, also.

FIG. 7 has been taken solely for the purpose of showing the manner in which this unit is formed, and it will be seen that what has been described as rib 116 is in fact a solid section considered with the fin 113. The dotted line in FIG. 7 illustrates only the configuration of the stem if it were not in section. The stem of course does not show along the lines of that dotted line when the section has been taken through the fin area as it has in this case.

FIG. 8 has been provided to show the effect upon the ball at the time it is struck by club 132. It will be noted that it is flattened out considerably on the back side causing a tendency upon the ball to elongate and in essence extrude into the head of the tee. Under normal circumstances, the ball would extrude far into the cupped supporting portion of a tee. However, in this case, the rib 116 prevents excessive extrusion of the ball into the tee and also forms a support in the desired direction of travel over the pointer 115.

Also, because of the slanted arrangement, and the leading edge fin, when struck, if the head of the club strikes the tee, as it frequently does, the tee will be removed from the turf in the forward slanting nature which will be natural as will be understood by those skilled in the art, and thus the strong resistance of a tee which has been inserted perpendicular to the turf is overcome.

It will be understood that in the method of this invention a ball could be supported in somewhat other manner than that shown and a good deal of the advantage could be achieved. For maximum advantage, a tee essentially as shown, and even preferably perhaps embodying a greater curvature as here-tofore described, is preferable. However, if one desired it might be possible, for example, to provide a supporting element for the ball wherein the provision of a rib something like rib 116 could be provided and such a device might even rest upon the turf rather than being inserted into the turf. The method of this invention could conceivably be practiced by such a device, since the rib and allignment features would be somewhat similar. It is certain that other modifications of an exact apparatus might occur to those skilled in the art, for the purpose of practicing the method set forth. An important detail of any such modification is the incorporation of provision for ease of use and ease of displacement of the appartus on being srtuck. In the embodiment shown, and important feature is the ease with which the tee fin 113 will slice into the turf and rock forward. This has been enhanced by the provision of the tapered leading edge 118 culminating in a pointed, or knife like edge 119 along the front of the fin. This aids in the insertion into the turf at the start and in the reduced friction required to displace the tee when the ball is struck.

While the embodiment of this invention shown and described is fully capable of achieving the objects and advantages desired, it is to be understood that such embodiment has been for purposes of illustration only, and not for purposes of limitation.

I claim:

1. The method of supporting a golf ball for being struck by a golf club comprising: (1) Forming a supporting surface for a golf ball; (2) Placing a force resistant rib within the supporting surface; (3) Placing said supporting surface in contact with the ball playing surface for a golf game in such a manner that the supporting surface is elevated above said ball playing surface and said rib is in alignment with the direction of travel of a tee-supported golf ball when it is struck by a player; and (4) Placing a golf ball on said supporting surface preparatory to being struck.

2. The method of claim 1 wherein the said supporting surface for the golf ball is provided with an elongated stem and the step of placing it in contact with the playing surface includes directionally angulating it in the intended direction of flight of the golf ball after being struck.

3. A golf tee comprising: (1) An elongated stem tapering to a point at one end and to an enlarged golf ball supporting area at the other end, said enlarged end having a suitable configuration to support a golf ball; (2) A rib formed within the configuration suitable to support a golf ball; (3) A pointer depending outward from the golf ball supporting surface and in alignment with said rib; and (4) a fin directionally aligned with said rib and pointer and extending from the said enlarged golf ball supporting portion along the stem.

4. The apparatus of claim 3 wherein said rib is of such configuration as to partially support a golf ball when placed thereon.

5. The apparatus of claim 4 wherein the enlarged golf ball supporting end of the tee is angularly disposed with relation with the axis of the stem.

6. The apparatus of claim 4 wherein the stem is curved in such a manner that the plane of the golf ball supporting surface is at approximately a 30° angular relationship to the stem adjacent the pointed portion.

7. The apparatus of claim 3 wherein the fin extends along the stem from the head to the point.

8. The apparatus of claim 3 wherin the fin tapers to a pointed edge on the edge not along the stem.

* * * * *